United States Patent [19]

Thibodaux

[11] 4,317,562

[45] Mar. 2, 1982

[54] MITER BOARD ACCESSORY FOR TABLE SAWS AND THE LIKE

[76] Inventor: Robert J. Thibodaux, R.F.D. 1, Box 597–A, Thibodaux, La. 70301

[21] Appl. No.: 145,028

[22] Filed: Apr. 30, 1980

[51] Int. Cl.[3] ..... B27B 27/10

[52] U.S. Cl. ..... 269/304; 83/435.2; 83/522; 83/477.2

[58] Field of Search ..... 83/435.1, 415, 522, 83/581, 477.2, 409; 269/304, 81

[56] References Cited

U.S. PATENT DOCUMENTS

| | | | |
|---|---|---|---|
| 2,881,812 | 4/1959 | Alumbaugh et al. | 83/435.1 |
| 2,905,210 | 9/1954 | Thomas | 83/416 |
| 3,901,498 | 8/1975 | Novak | 83/581 |
| 4,111,409 | 9/1978 | Smith | 83/435.1 |

*Primary Examiner*—Donald R. Schran

*Attorney, Agent, or Firm*—C. Emmett Pugh & Associates

[57] ABSTRACT

A slotted material holder which is used in combination with a conventional circular table saw or the like to allow specified angular cuts to be made safely in boards as they are guided pass the saw. The miter board holder of the invention is adapted for usage with no modifications to the saw or table being necessary. The holder allows for the cutting of long boards in that both ends of the board may extend outwards from the holder allowing the cut to be made at any location along the board. The holder includes a flat base member upon which a mounted three sets of board guide elements projecting above its upper surface-a lateral one located at one end extending pass both sides of the slot for the saw blade; a side set extending diagonally to the slot; and an intermediate set. A moveable jam (FIG. 6) is included to be used on the base member in association with the intermediate set of guide elements.

4 Claims, 6 Drawing Figures

MITER BOARD ACCESSORY FOR TABLE SAWS AND THE LIKE

BACKGROUND OF THE INVENTION

1. Field of the Invention

The invention relates to material holding miter board accessories especially adapted for use with conventional circular saws or the like to obtain angled cuts.

2. Description of the Prior Art

Various types of devices which relate to obtaining angled cuts in boards date back to the 1900's. J. W. Alumbaugh, et al (U.S. Pat. No. 2,881,812 issued Apr. 14, 1959) shows a structure composed of a base, with riders on its undersides for mating with the slots in the bed of the table saw, and 45 degree elements as well as 90 degree elements mounted on its upper side for the positioning of the lumber to be cut with those degree cuts. As such, however, the invention does not allow diagonal cuts to be made along any section of the board, but requires that the cut come at one end of the board, necessitating in many instances a preliminary 90 degree cut in order to make the desired diagonal cut, resulting in a double expenditure of labor and the loss of a similar diagonal cut on the opposite end of the board. Since the base is made in two parts, blade guide base supports are needed to both hold the base sections together as well to absorb moments and shear forces. Because the guides must clear the blade as it passes under the guide, their height must be made higher, resulting in additional bulkiness and requiring additional material.

For further background, it is noted that the following patents relate to material holders for use with a saw.

| U.S. Pat. No. | Patentee(s) | Issue Date |
|---|---|---|
| 2,881,812 | J. W. Alumbaugh, et al | April 19, 1959 |
| 2,260,883 | T. M. Castle | October 28, 1941 |
| 1,872,388 | L. J. Bazzoni | August 16, 1932 |
| 913,078 | J. Weber | February 23, 1909 |
| 812,574 | J. S. Linton | February 13, 1906 |
| 556,658 | J. Barnes | March 17, 1890 |
| 420,739 | Schmitz | February 4, 1890 |
| 305,563 | Baer | September 23, 1884 |

SUMMARY OF THE INVENTION

In specific, the invention improves on the concept of a material holder, as used with a circular table saw or the like, which allows specified angular cuts to be made safely in boards as they are guided through the saw.

The invention uses fixed cutting guides for precise 45 degree and 90 degree cuts; employs guide bars on which the base slides in slots on the table of the saw, allowing the board to be precisely cut; and allows for diagonal (45 degree) cuts to be made in any section of the board by allowing the ends to extend outward from the holder in either direction. The invention achieves all of this versatility with a very compact, low height miter board with a minimum amount of material.

BRIEF DESCRIPTION OF THE DRAWINGS

For a further understanding of the nature and objects of the present invention reference should be made to the following detailed description, taken in conjunction with the accompanying drawings, in which like parts are given like reference numerals and wherein.

DETAILED DESCRIPTION OF THE PREFERRED EMBODIMENT

In brief, what is described hereafter is the preferred embodiment of an improved material holder to be used in conjunction with a circular table saw or the like, in which specified angular cuts can be made in any section of the board as desired.

Figure 1:
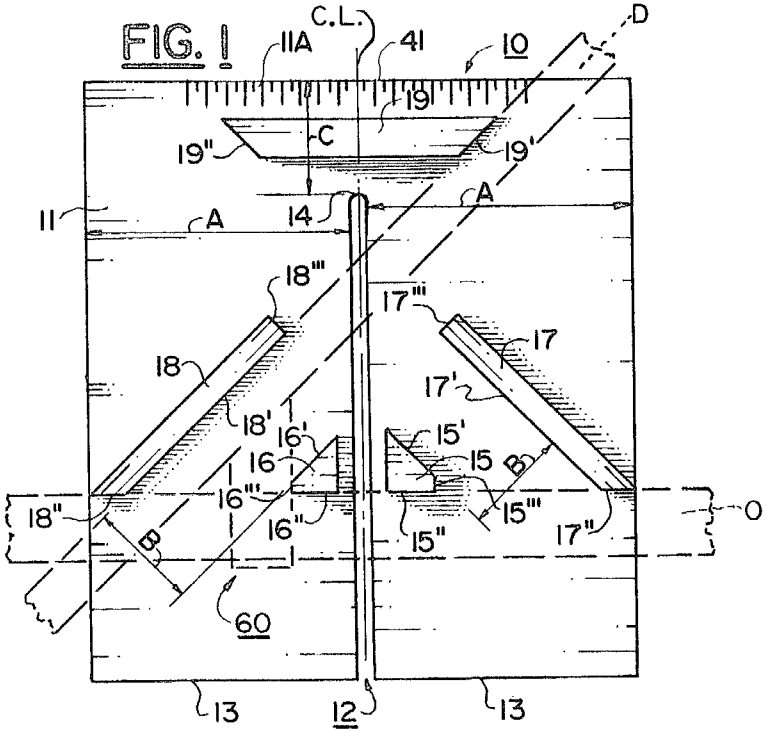
FIG. 1 is a top view of the preferred embodiment.

In FIG. 1 a top view of the preferred embodiment of the material holder 10 is seen. The holder 10 as placed with guide rails 51 (see FIG. 5) inserted in the tracks of the circular table saw (unillustrated) allows for cutting of boards along the specified angles of 45 and 90 degrees as desired.

The principal problem in a material holder of this type is the integration of parts in a manner so as to allow maximum flexibility in the choice of which section of the board the cut, and in particular the angled forty-five degree cut, is to be placed. In order to achieve this, the base of the holder in the present invention is preferably rigid so as to allow a minimum number of laterally extending braces or supports to be used. To meet this requirement, the base 11 of the holder 10 is made of one, integral piece with a slot 12 starting from the front 13 and running along the centerline of the base 11 for an exemplary eighty percent of the length of the holder or as far as lateral guide 19. By having the back section, across "C", intact, moments and shear force are able to be absorbed across dimension "A" and/or "C".

This eliminates the necessity for blade guides to be installed on the front and rear of the holder and permits flexibility as to the positioning and number of board guides resulting in an embodiment in which boards may be diagonally cut along any sections of the boards as desired. Since no rear blade guides are necessary (as in the prior art Alumbaugh device), the length of the top surface 11A adjoining rear side 41 can be ruled as necessary to allow some dimensional measurements to be taken. In construction of the slot 12 the end 14 may be cut in a rounded or circular manner and at an angle so as to avoid stress risers as much as possible.

With the base functionally embodied, a minimum number of board guides need be employed. The selection of an "X" configuration allows a minimum or skeleton number of parts. The positioning of triangularly shaped, intermediate guides 15 and 16 symmetrically about the slot 12 forms the bottom half of the "X" and serves as the basic backbone of the embodiment. This allows forty-five degree cuts to be made with the board placed along sides 15' (or 16') or ninety degree cuts to be made with the board placed along sides 15" and 16" as the circular blade of the table saw rotates and moves down the slot 12. The addition of side guides 17 and 18 symmetrically about and on opposite sides of the slot 12 defines the width "B" of the legs of the "X" as well as provides primary support for the boards as they are cut either diagonally or at an angle of ninety degrees.

Figure 6:
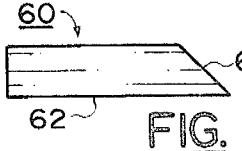
FIG. 6 is a top view of the board jam as used in conjunction with the preferred embodiment of FIG. 1.

As such, guides 15 and 16 can be used in combination with a supplemental jam 60 (note FIG. 6), which jam 60 has a face 61 cut at a forty-five degree angle, to hold the board to be cut in place against face 18' or 17' of guides 18 and 17, respectively. To accomplish this function, face 62 of jam 60 is placed against face 16''' (or 15'''), with the face 61 parallel to 18' (or 17') so as to fit tightly against the board to be cut and tightly wedge the board against face 18' (or 17'); note phantom-lined jam element 60 in FIG. 1. This allows any size board, up to a width equal to that of "B", to be easily and safely cut in a diagonal (fourty-five degree) way (not phantom-lined diagonal board "D" of FIG. 1).

Figure 4:
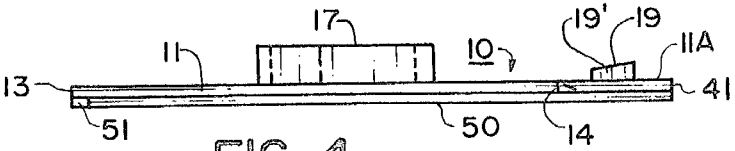
FIG. 4 is a side view of the preferred embodiment of FIG. 1.
Figure 3:
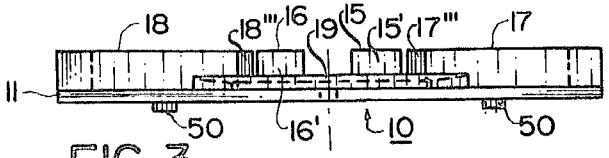
FIG. 3 is a rear end view of the preferred embodiment of FIG. 1.
Figure 2:
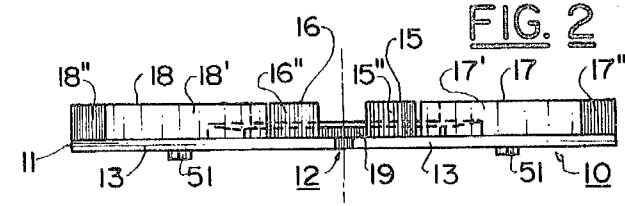
FIG. 2 is a front end view of the preferred embodiment of FIG. 1.

In construction and placement of guides 17 and 18, side 18' is placed parallel to and at a width "B" from side 16', and side 17' is placed parallel to and at a width "B" from side 15'. Sides 17'' and 18'' are cut at an angle so as to allow sides 17'' and 18'' to be parallel to sides 16'' and 15'' and on a line formed by sides 16'' and 15'' (see also FIG. 4 and FIG. 2). Side 18''' is cut so that its face is parallel to and on a line with the face of side 15'. Side 17''' is cut so that its face is parallel to and on a line with the face of side 16'. For the diagonal cut, sides 15' and 18''' can be used as guides as well as sides 16' and 17''' (see also FIG. 3) as desired.

The addition of the lateral guide 19 provides additional board support during cutting and allows sides 17' and 19'' to be used as board guides as well as sides 18' and 19'; as desired. In the construction of the guide 19 the diagonal, terminal face of side 19'' is cut so as to be parallel to and on a line with the face of side 17', and the face of side 19' is cut so as to be parallel to and on a line with the face of side 18'. As such guide 19 not only serves as a board guide but also as a bar to push and pull the miter board or holder 10 when in use by the operator. Using the bar 19 as a push and pull bar and the guide elements 15–18 for ninety degree cuts is safer in that the hands of the operator are always away from the saw blade during such cuts.

The last combination of guides, namely sides 17' and 19'', as well as side 18' and 19', provide the best support and allows the best alignment for consistent diagonal cuts when the board is butted tightly against them. The combination of sides 19'', 17', 15' and 18''' or 19', 18', 16' and 17''' allows boards to be cut of width or thickness equal to "B" and permits either or both ends of the board to extend outwardly from the base 11, allowing the board to be cut diagonally anywhere along its length, as desired. The guide formed by the faces of sides 18'', 16'', 15'', and 17'' also allows for ninety degree cuts to be made anywhere along the length of the board as desired (note phantom-lined, orthogonal board "O" in FIG. 1).

Figure 5:
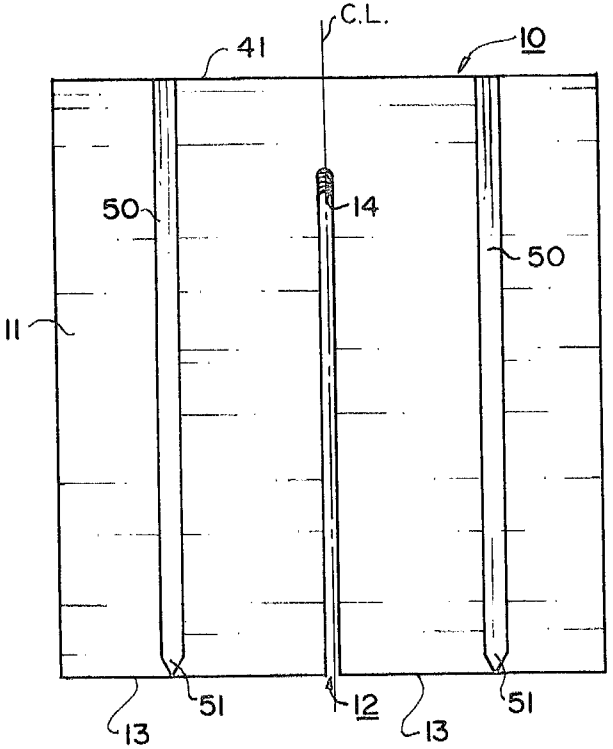
FIG. 5 is a bottom view of the preferred embodiment of FIG. 1.

In FIG. 5 a bottom view of the preferred embodiment is seen. Guide bars 50 are placed so that they may slide in tracks on the table of the saw and thereby maintain the line of cut established by the blade of the saw. Guide bars 50, preferably, will be made with pointed ends 51 so as to allow easy and quick placement of the holder 10 onto the table of the saw.

Exemplary dimensions for the preferred embodiment are set out below:

| | |
|---|---|
| Width of slot 12 | $\frac{5}{8}$" |
| Length of longitudinal sides of base member 11 | 20" |
| width of base members 11 | 18 $\frac{1}{8}$" |
| dimension "A" | 8 $\frac{3}{4}$" |
| dimension "B" | 3 $\frac{3}{4}$" |
| length (longer edge) of guide elements 17, 18 | 8 $\frac{1}{4}$" |
| thickness of guide elements 17, 18 | $\frac{7}{8}$" |
| length (longer edge) of push-pull bar 19 | 10 $\frac{3}{4}$" |
| thickness of push-pull bar 19 | 1 $\frac{1}{4}$" |
| "equal" sides of "triangular" guide elements 15, 16 | 2" |
| spacing of guide elements 15,16 from slot 12 | $\frac{1}{2}$" |
| spacing back of lateral "ninety degree" surfaces 15", 16", 17" and 18" from leading edge | 5 $\frac{1}{2}$" |
| spacing of bar 19 from rear edge 41 | 1 $\frac{1}{4}$" |

The foregoing dimensions are of course merely exemplary and are subject to great variation, as may be desired.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed is:

1. A miter board material holder for a circular table saw or the like for cutting boards and the like, comprising:

a laterally extending base member having an at least generally flat upper surface;

a series of five, vertically projecting, board guide element fixedly mounted on a first, upper side of said base and vertically projecting above said upper surface;

elongated, straight slot means for accommodating and allowing the saw blade of the saw to pass along said base member, said slot means comprising a slot through said base member extending along a substantial portion of said base member but through at most only one of its sides;

one of said guide elements being a laterally extending one, located in juxtaposition to the internal, terminal end of said slot and extending pass both sides thereof with a continuous vertical surface and terminating at the ends away from said slot in side, end, vertical surfaces which make forty-five degree angles with said slot, said side, end, vertical surfaces being usable for positioning a board at an angle of forty-five degrees to said slot and hence to a saw blade in said slot for producing a forty-five degree cut through the board;

two of said guide elements being extended, side, board guide elements symetrically positioned on opposite sides of said slot and extending along their longitudinal lengths at forty-five degree angles to said slot, said side, end, vertical surfaces of said laterally extending guide element in conjunction with the inwardly facing, longitudinal, vertical, sides of said side guide elements defining an "X" configuration for supporting boards on either side of said slot for producing forty-five degree cuts in the boards; and two of said guide elements being relatively short intermediate board guide elements symetrically positioned on opposite sides of said slot and inboard of said two side guide elements, said guide elements terminating at vertical ends facing away from said laterally extending guide element forming a common vertical plane extending laterally across said base member at a ninety degree angle to said slot, the vertical ends of said side board guide elements at the ends away from said laterally extending guide element terminating in vertical guide surfaces making forty-five degree angles with the longitudinal axes of the extended side board guide elements, said guide surfaces being located in said common vertical plane for supporting a board across said slot for producing a ninety degree cut in the board.

2. The holder of claim 1, wherein there is further included a supplemental, moveable jam associated with said base member terminating at one end in a forty-five degree diagonal surface and having parallel sides making an angle of forty-five degrees with said diagonal surface, said intermediate guide elements terminating on their sides closest to said said guide elements and furtherest away from said slot in vertical jam surfaces which are parallel to said slot, said jam being positionable with one of its parallel sides against either one of said jam surfaces with its diagonal surface facing the adjacent one of said guide elements.

3. The holder of claim 1, wherein said base member is an integral, one piece member which is rigid and flat.

4. The holder of claim 1, wherein the area within the "X" configuration on said base member is free of any upwardly extending projections, allowing boards to be placed anywhere along their lengths in either one of the legs of the "X" configuration over said slot against said laterally extended guide element and one of said side board guide elements for producing a forty-five degree cut anywhere along the board's length as desired.

* * * * *